US008643450B2

(12) United States Patent
Mi et al.

(10) Patent No.: US 8,643,450 B2
(45) Date of Patent: Feb. 4, 2014

(54) VARIABLE DISTRIBUTED CONSTANT LINE, VARIABLE FILTER, AND COMMUNICATION MODULE

(75) Inventors: Xiaoyu Mi, Kawasaki (JP); Osamu Toyoda, Kawasaki (JP); Satoshi Ueda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 624 days.

(21) Appl. No.: 12/939,152

(22) Filed: Nov. 3, 2010

(65) Prior Publication Data

US 2011/0273246 A1 Nov. 10, 2011

(30) Foreign Application Priority Data

Nov. 6, 2009 (JP) ..... 2009-254925

(51) Int. Cl.
*H01P 1/203* (2006.01)
*H01P 7/08* (2006.01)

(52) U.S. Cl.
USPC ..... 333/205; 333/235

(58) Field of Classification Search
USPC ..... 333/204, 205, 235, 219
See application file for complete search history.

(56) References Cited

U.S. PATENT DOCUMENTS

| | | | | |
|---|---|---|---|---|
| 5,406,233 | A * | 4/1995 | Shih et al. | 333/161 |
| 5,408,053 | A * | 4/1995 | Young | 174/264 |
| 5,619,061 | A | 4/1997 | Goldsmith et al. | |
| 6,549,097 | B2 | 4/2003 | Guillon et al. | |
| 2003/0107458 | A1 * | 6/2003 | Callaway et al. | 333/202 |
| 2006/0087388 | A1 * | 4/2006 | Kawai et al. | 333/219 |
| 2008/0266029 | A1 | 10/2008 | Mi et al. | |
| 2010/0237965 | A1 | 9/2010 | Mi et al. | |

FOREIGN PATENT DOCUMENTS

| | | | |
|---|---|---|---|
| CN | 101841074 | | 9/2010 |
| EP | 1986319 | | 10/2008 |
| EP | 2230714 | | 9/2010 |
| JP | 08-213803 | A | 8/1996 |
| JP | 2002-198780 | A | 7/2002 |
| JP | 2005-244831 | A | 9/2005 |
| JP | 2008-278147 | | 11/2008 |
| JP | 2009-516350 | A | 4/2009 |
| WO | WO-02/096166 | | 11/2002 |
| WO | WO-2007/061406 | A1 | 5/2007 |

OTHER PUBLICATIONS

Fourn et al., "MEMS Switchable Interdigital Coplanar Filter", pp. 320-324, Jan. 2003.

Abbaspour-Tamijani et al., "Miniature and Tunable Filters Using MEMS Capacitors", pp. 1878-1885, Jul. 2003.

(Continued)

*Primary Examiner* — Benny Lee
*Assistant Examiner* — Gerald Stevens
(74) *Attorney, Agent, or Firm* — Fujitsu Patent Center

(57) ABSTRACT

A variable distributed constant line includes a substrate, a signal line that is provided on the substrate, and includes a first line portion and a second line portion facing each other, a movable electrode that is provided above the substrate, and straddles both the first line portion and the second line portion in a manner to face the first line portion and the second line portion, and a driving electrode that is provided on the substrate in a manner to face the movable electrode, attracts the movable electrode by an action of a voltage applied between the driving electrode and the movable electrode, and changes a distance between the signal line and the movable electrode.

6 Claims, 9 Drawing Sheets

(56) References Cited

OTHER PUBLICATIONS

Peroulis et al., "Tunable Lumped Components with Applications to Reconfigurable MEMS Filters", pp. 341-344, 2001.

Chinese Official Communication dated Dec. 20, 2011 for corresponding Chinese patent application No. 201010537486.4 and its English translation.

Extended European search report dated Feb. 15, 2011 for corresponding European patent application No. 10189258.6.

Japanese Office Action mailed Apr. 16, 2013 for corresponding to Japanese Application No. 2009-254925, with Partial English-language Translation.

* cited by examiner

VARIABLE DISTRIBUTED CONSTANT LINE, VARIABLE FILTER, AND COMMUNICATION MODULE

CROSS-REFERENCE TO RELATED APPLICATION

This application is based upon and claims the benefit of priority of the prior Japanese Patent Application No. 2009-254925, filed on Nov. 6, 2009, the entire contents of which are incorporated herein by reference.

FIELD

The embodiments discussed herein are related to a variable distributed constant line used, for example, as a transmission line and the like for high-frequency signals, a variable filter used, for example, as a band-pass filter for high-frequency signals and the like, and a communication module.

BACKGROUND

In recent years, the market of mobile communication systems such as cellular phones has been expanding, and the functionality provided by the service thereof has been becoming sophisticated. Along with this development, the frequency bands used for the mobile communications are gradually shifting toward higher frequency bands of gigahertz (GHz) or higher and, at the same time, tend to use multi-channels. In addition to this, a future possibility of the introduction of Software-Defined-Radio (SDR) technologies is actively discussed.

In the meantime, a tunable high-frequency device using MEMS (Micro Electro Mechanical Systems) technologies is attracting attention. A MEMS device (micromachine device) utilizing the MEMS technologies makes it possible to attain a high Q (quality factor) and can be applied to a variable filter etc. operating in a high frequency band (Japanese Laid-open Patent Publication No. 2008-278147; D. Peroulis et al, "Tunable Lumped Components with Applications to Reconfigurable MEMS Filters", 2001 *IEEE MTT-S Digest*, p 341-344; E. Fourn et al., "MEMS Switchable Interdigital Coplanar Filter", *IEEE Trans. Microwave Theory Tech.*, vol. 51, NO. 1, p 320-324, January 2003; and A. A. Tamijani et al, "Miniature and Tunable Filters Using MEMS Capacitors", *IEEE Trans. Microwave Theory Tech.*, vol. 51, NO. 7, p 1878-1885, July 2003). Further, the MEMS device, because of its small size and low loss, is often used in a CPW (Coplanar Waveguide) distributed constant resonator.

"A. A. Tamijani et al, "Miniature and Tunable Filters Using MEMS Capacitors", *IEEE Trans. Microwave Theory Tech.*, vol. 51, NO. 7, p 1878-1885, July 2003" discloses a filter having a structure in which a plurality of variable capacitors based on MEMS device straddle three distributed constant lines. In this filter, a control voltage Vb is applied to a driving electrode of the MEMS device to thereby displace variable capacitors, vary gaps between the variable capacitors and distributed constant lines, and as a result vary the capacitance. As the capacitance changes, the pass band of the filter changes. For example, by changing the control voltage in a range between 0 and 80 V, the pass band of the filter changes in a range between 21.5 and 18.5 GHz.

However, according to the conventional filter as discussed above, although it is possible to vary the center frequency of the pass band, the bandwidth of the pass band can not be varied.

SUMMARY

According to an aspect of the invention, a variable distributed constant line includes a substrate, a signal line that is provided on the substrate, and includes a first line portion and a second line portion facing each other, a movable electrode that is provided above the substrate, and straddles both the first line portion and the second line portion in a manner to face the first line portion and the second line portion, and a driving electrode that is provided on the substrate in a manner to face the movable electrode, attracts the movable electrode by an action of a voltage applied between the driving electrode and the movable electrode, and changes a distance between the signal line and the movable electrode.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

First, a description will be given of a variable filter that is provided with a variable capacitor based on the MEMS technologies arranged in a signal line and that can adjust the pass-band width.

Figure 6:
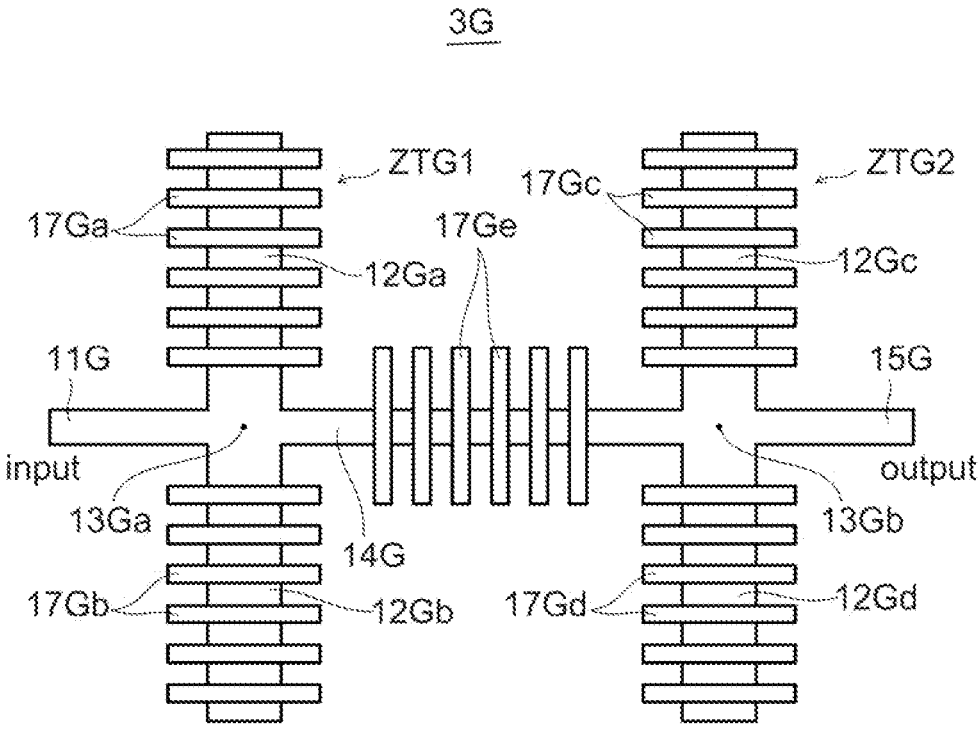
FIG. 6 is a plan view illustrating a variable filter taken as a reference purpose.

Specifically, as illustrated in FIG. 6, a variable filter 3G includes resonant lines 12Ga-12Gd, a coupling portion 14G, and variable capacitors 17Ga to 17Ge.

The resonant lines 12Ga-12Gd have propagation lengths $L_1$, $L_2$, $L_3$, and $L_4$, respectively. By arranging the propagation lengths $L_1$ and $L_3$ of the resonant lines 12Ga and 12Gc to be identical with each other, and the propagation lengths $L_2$ and $L_4$ of the resonant lines 12Gb and 12Gd to be identical with each other, two pairs of resonant lines ZTG1 and ZTG2 have the same pass-through loss properties. Therefore, by differentiating the propagation lengths from each other so that the two pairs of resonant lines ZTG1 and ZTG2 have different pass-through loss properties from each other, it is possible to obtain desired pass-through loss properties.

Figure 7:
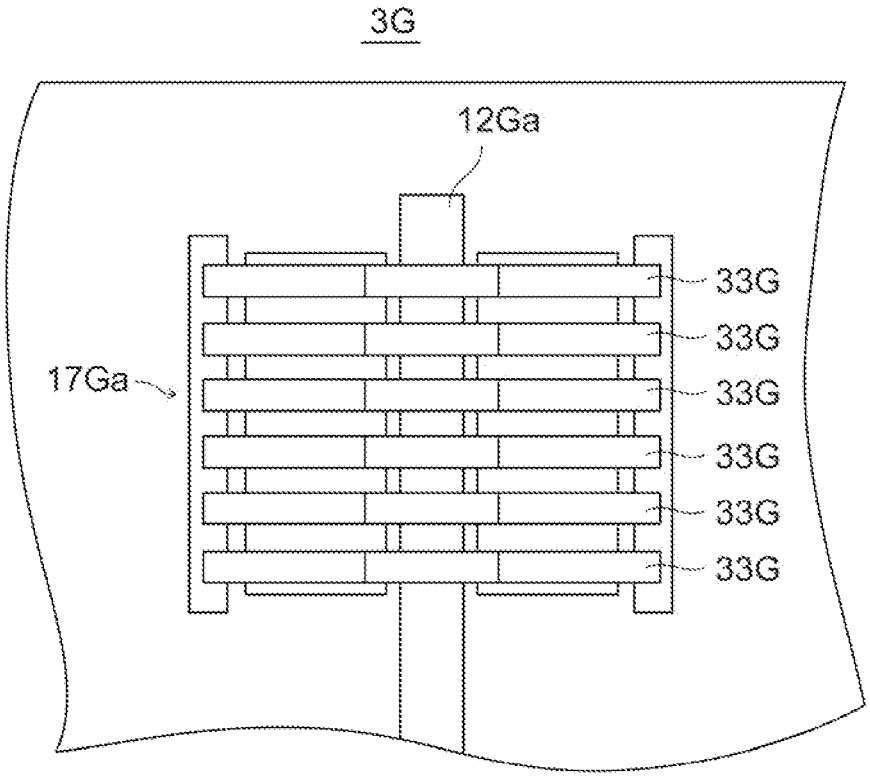
FIG. 7 is a partially enlarged view of the variable filter of FIG. 6.

Referring to FIG. 7, each of variable capacitors 17Ga-17Gd is provided with a plurality of movable electrodes 33G arranged to straddle the resonant line 12Ga, 12Gb, 12Gc, or 12Gd corresponding thereto with a predetermined amount of gap provided therebetween. When the movable electrodes 33G are arranged closer to the resonant line 12Ga, the capacitance therebetween increases, and the propagation length becomes longer so that a resonant wavelength λ becomes longer.

By operating the variable capacitors 17Ga to 17Ge independently from each another and adjusting individual capacitances thereof, it is possible to adjust and set a passband center wavelength $\lambda_0$, attenuation peak wavelengths $\lambda_L$ and $\lambda_H$, and a pass-band width $\lambda_T$ at various values.

According to the variable filter illustrated in FIGS. 6 and 7, since areas on both sides of each of the resonant lines 12Ga-12Gd are left as free areas, driving electrodes for driving the variable capacitor can be freely disposed. Consequently, it is possible to make the area of the driving electrode larger, leading to the improvement of the stability in driving.

First Embodiment

Figure 1:
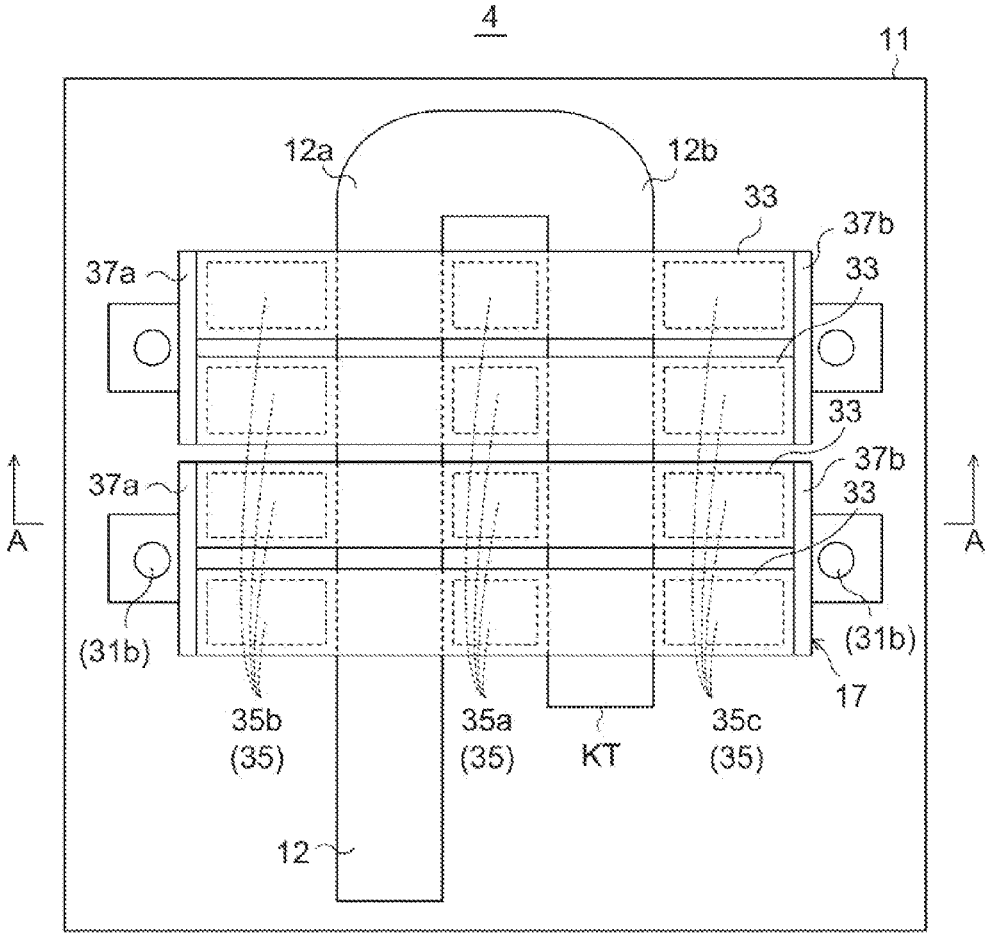
FIG. 1 is a plan view illustrating an example of a variable distributed constant line according to a first embodiment.

Referring to FIG. 1, a variable distributed constant line 4 according to the first embodiment is provided with a substrate 11, a line 12, and a variable capacitor 17.

For example, a Low Temperature Co-fired Ceramics (LTCC) substrate having multilayered internal wiring is used as the substrate 11. The line 12 and the variable capacitor 17 are formed on the surface of the substrate 11 by using MEMS technologies. Alternatively, the line 12 and the variable capacitor 17 may be formed on a wafer including the Low Temperature Co-fired Ceramics substrate or another appropriate substrate.

The line 12 is provided in a meandering pattern on the substrate 11 and includes a first line portion 12*a* and a second line portion 12*b* that are facing each other. The first line portion 12*a* and the second line portion 12*b* extend in parallel with each other in a circumventing manner.

More specifically, the line 12 includes the first line portion 12*a* that stretches linearly, and the second line portion 12*b* that is folded at a leading portion of the first line portion 12*a* and extends in parallel with and with a distance away from the first line portion 12*a*. A leading edge of the second line portion 12*b* is formed as an open end KT which is electrically opened. However, the leading edge may be connected to the ground instead of being arranged as the open end KT.

The variable capacitor 17 includes a plurality of movable electrodes 33 and a plurality of driving electrodes 35.

Each of the movable electrodes 33 is provided above the substrate 11 and straddles over and faces the first line portion 12*a* and the second line portion 12*b*. Each of the driving electrodes 35 is provided on the substrate 11 so as to face each of the movable electrodes 33, attracts the movable electrodes 33 by an action of an electrostatic attractive force generated by a voltage applied between the movable electrodes 33 and the driving electrodes 35, and changes the distance between the line 12 and the movable electrodes 33.

Provided as the driving electrodes 35 are a first electrode 35*a*, a second electrode 35*b*, and a third electrode 35*c*.

The first electrode 35*a* is arranged between the first line portion 12*a* and the second line portion 12*b*. The second electrode 35*b* is arranged in a manner to interpose the first line portion 12*a* between the first electrodes 35*a* and the second electrode 35*b*. The third electrode 35*c* is arranged in a manner to interpose the second line portion 12*b* between the first electrode 35*a* and the third electrode 35*c*.

An identical voltage (control voltage) Vb relative to the movable electrodes 33 is applied to the first electrode 35*a*, the second electrode 35*b*, and the third electrode 35*c*.

Alternatively, an identical voltage Vb1 may be applied to the second electrode 35*b* and the third electrode 35*c*, and a voltage Vb2 different from that applied to the second electrode 35*b* and the third electrode 35*c* may be applied to the first electrode 35*a*. For example, the voltage Vb2 applied to the first electrode 35*a* may be arranged to be larger than the voltage Vb1 applied to the second electrode 35*b* and the third electrode 35*c*, or, in an opposite manner, the voltage Vb2 may be arranged to be smaller than the voltage Vb1.

Hereinafter, a detailed description will be given of the variable distributed constant line 4.

Figure 2:
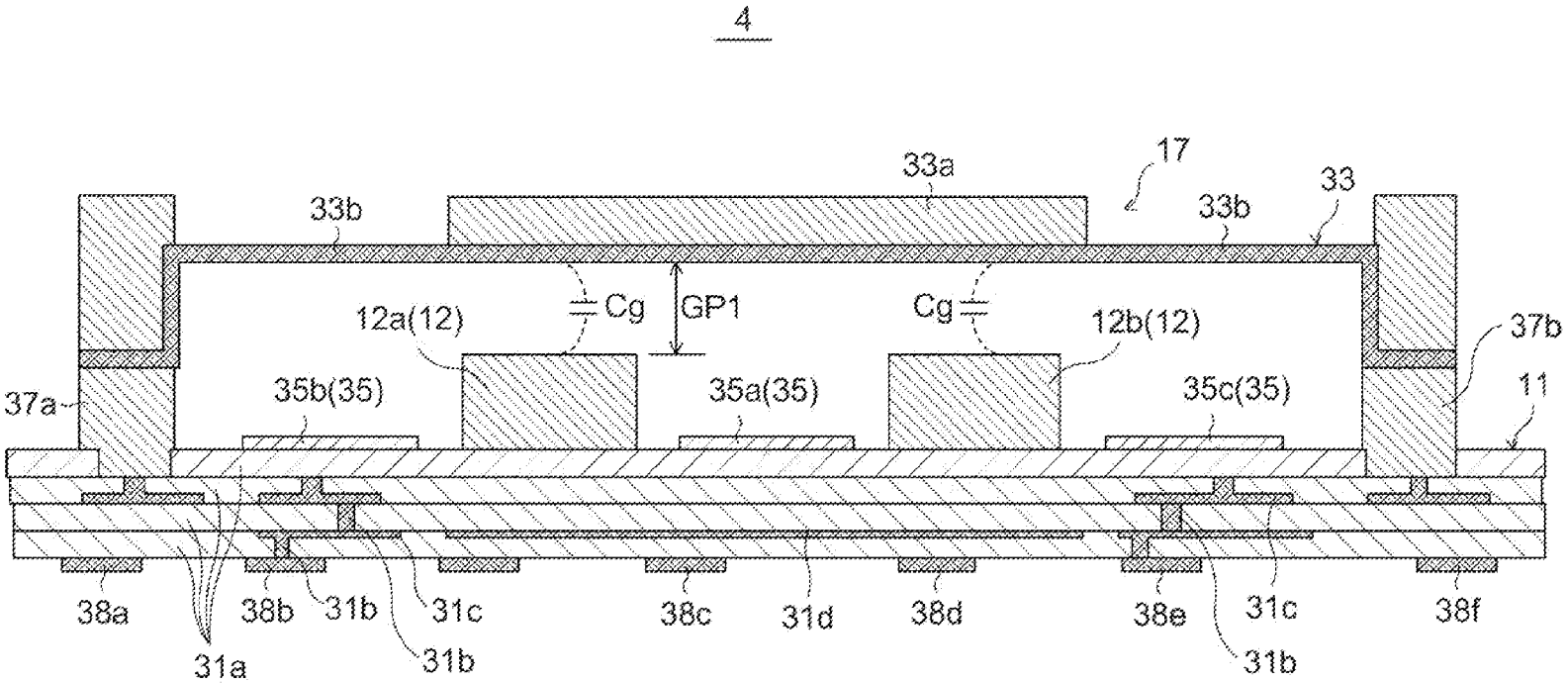
FIG. 2 is a cross sectional view of the variable distributed constant line of FIG. 1.

Referring to FIG. 2, the substrate 11 is formed by bonding a plurality of insulating layers 31*a* to one another. In an example illustrated in FIG. 2, four of the insulating layers 31*a* are provided. A through-hole is formed in each of the insulating layers 31*a* in a manner to penetrate through from a main surface of one layer to a main surface of another layer, and a via 31*b* provided with a conductive portion is formed in the through-hole. A wiring pattern 31*c* is formed between at least one pair of the insulating layers 31*a* as internal wiring. A part of the wiring pattern 31*c* is arranged as a ground layer 31*d* connected to the ground.

The ground layer 31*d* faces the line 12 with a predetermined distance by interposing the insulating layers 31*a* between the ground layer 31*d* and the line 12 to thereby form a microstrip-line configuration.

The wiring patterns 31*c*, the wiring patterns 31*c* and the pad portions 38*a*-38*f*, and the wiring patterns 31*c* and the line 12 are individually connected to each other at positions deemed necessary by the vias 31*b*. Here, the insulating layers 31*a* can be realized, for example, by the Low Temperature Co-fired Ceramics (LTCC). The LTCC material may sometimes contain $SiO_2$. However, without limiting to the LTCC, the insulating layers 31*a* may be formed using other dielectrics.

The line 12, the driving electrodes 35, i.e., the first to third electrodes 35*a* to 35*c*, and anchor portions 37*a* and 37*b* are formed on the surface of the obverse side of the substrate 11. The pad portions 38*a*-38*f* are formed on the surface of the reverse side of the substrate 11. The line 12 is formed of a low-resistance metallic material, for example, such as Cu, Ag, Au, Al, W, or Mo. The thickness of the line 12 is, for example, about 0.5-20 μm.

The ground layer 31*d*, the driving electrodes 35, and the anchor portions 37*a*-37*b* are electrically connected to any of the pad portions 38*a*-38*f* individually by way of the internal wiring and vias 31*b* inside the substrate 11. Here, a dielectric film may be formed on the surface of the driving electrodes 35.

The movable electrodes 33 are supported by the anchor portions 37*a* and 37*b*. The movable electrodes 33 and the anchor portions 37*a* and 37*b* are electrically connected to each other. The movable electrodes 33 are formed of an elastically deformable low-resistant metallic material, for example, such as Au, Cu, or Al; an alloy containing any of Au, Cu, and Al; or a multilayered films including any of these metals or the alloy. Each of the movable electrodes 33 includes a thick-walled movable capacitor electrode 33*a* formed in the center thereof, and thin-walled spring electrodes 33*b* and 33*b* formed at both ends thereof.

The variable capacitor 17 is formed of these movable electrodes 33, the driving electrodes 35, the anchor portions 37*a* and 37*b*, and so on.

A capacitance Cg is added to the line 12 by the movable capacitor electrode 33*a*. The movable capacitor electrode 33*a* or a portion formed of the movable capacitor electrode 33*a* and the line 12 may be sometimes called "Load-Capacitor".

Further, a portion formed of the movable electrode 33 and the driving electrodes 35 may be sometimes called "parallel plate type actuator".

A portion between the upper face of the line 12 and the lower face of the movable capacitor 33*a* includes a predetermined gap GP1 in a free state and the resultant capacitance Cg. The size of the gap GP1 is, for example, about 0.1-10 μm.

Here, a dielectric dot may be provided on the surface of the line 12. With the dielectric dot being provided, the capacitance Cg between the line 12 and the movable capacitor electrode 33*a* increases, and a frequency variable range by means of the variable capacitor 17 increases. The dielectric dot also takes on a role to prevent a short circuit from being established when the movable capacitor electrode 33 is drawn toward the line 12.

Although it is not illustrated, the variable distributed constant line 4, in its entirety, including the line 12, the movable electrodes 33, and the like is covered by a packaging member on the upper surface of the substrate 11 so that the variable distributed constant line 4, in its entirety, is sealed.

The variable distributed constant line 4 constituted in this way can be soldered to the surface of an unillustrated printed circuit board by utilizing the pad portions 38*a*-38*f*. This arrangement enables the surface mounting. The connection to the line 12 may be arranged by utilizing the pad portions 38*a*-38*f*, or the connection may be arranged in such a way that a high-frequency signal is directly inputted to the line 12.

Applying the voltage (control voltage) Vb to the driving electrode 35 through the pad portions 38*a*-38*f* induces an electrostatic attractive force between the driving electrode 35 and the movable electrode 33. The movable electrode 33 deforms to change the size of the gap GP1 in accordance with the intensity of the control voltage Vb, i.e., the intensity of the electrostatic attractive force. The capacitance Cg between the surface of the line 12 and the movable electrode 33 varies in accordance with the change in the size of the gap GP1.

If the line 12 is a resonant line, the propagation length L thereof changes accordingly. The propagation length L of the line 12, i.e., the resonant wavelength λ, can be adjusted by adjusting the value of the voltage Vb.

In the variable distributed constant line 4, a microstrip-line configuration is constituted by the ground layer 31*d* inside the substrate 11 and the line (signal line) 12 formed on the surface of the substrate 11. In the microstrip-line type transmission line, the ground layer is not formed on the surface of the substrate on which the line 12 is formed. This allows wide free areas to be provided on both sides of the line 12. Accordingly, the driving electrode 35 can be arranged relatively freely in these free areas.

According to the variable distributed constant line 4 of this embodiment, the line 12 is arranged in a meandering pattern, and the first line portion 12*a* and the second line portion 12*b* face the movable electrode 33. This makes it possible to increase the capacitance Cg and increase the frequency variable range by means of the variable capacitor 17.

Also, the line 12 is folded in a meandering pattern, and the driving electrodes 35 are individually disposed on both sides next to respective portions where the line 12 is folded. This means that free areas are also provided on both sides of each of the line portions 12*a* and 12*b*. Three electrodes (the first to third electrodes 35*a*-35*c*) are provided in these free areas to thereby form a parallel plate type actuator. With this arrangement, the area of the driving electrode 35 can be further enlarged.

As a result, it is possible to increase a driving force even with the same voltage Vb being applied. This makes it possible to increase the spring constant of the movable electrode 33 and suppress a self-actuation phenomenon caused by a high frequency signal.

The area of the driving electrode 35 can be sufficiently enlarged relative to that of the movable electrode 33. This makes it possible to ignore the Coulomb force acting between the line 12 and the movable electrode 33 and caused by the high-frequency signal supplied to the line 12. Accordingly, this also makes the displacement action of the movable electrode 33 stable and suppresses the self-actuation phenomenon.

Further, if the same driving force is to be obtained from the movable electrode 33, the voltage Vb can be reduced.

In this way, the stability of the operation of the movable electrode 33 can be further improved. This improves the reliability of the variable distributed constant line 4. In addition, since the layout of the line 12, the driving electrode 35, and the like can be easily and efficiently arranged, it is possible to reduce an overall size of the variable distributed constant line 4.

Second Embodiment

Next, a description will be given of a variable distributed constant line 4B according to the second embodiment.

The variable distributed constant line 4B of the second embodiment is basically the same in its operation as the variable distributed constant line 4 of the first embodiment, although the shape of the line 12B, the quantity and the layout of the driving electrodes 35B, and the like are different from those in the first embodiment. Therefore, parts having the similar functions to those of the variable distributed constant line 4 of the first embodiment are provided with the same symbols or with "B" added to the symbols, and thus a description thereof will be omitted or simplified. The same is applied to other embodiments.

Figure 3:
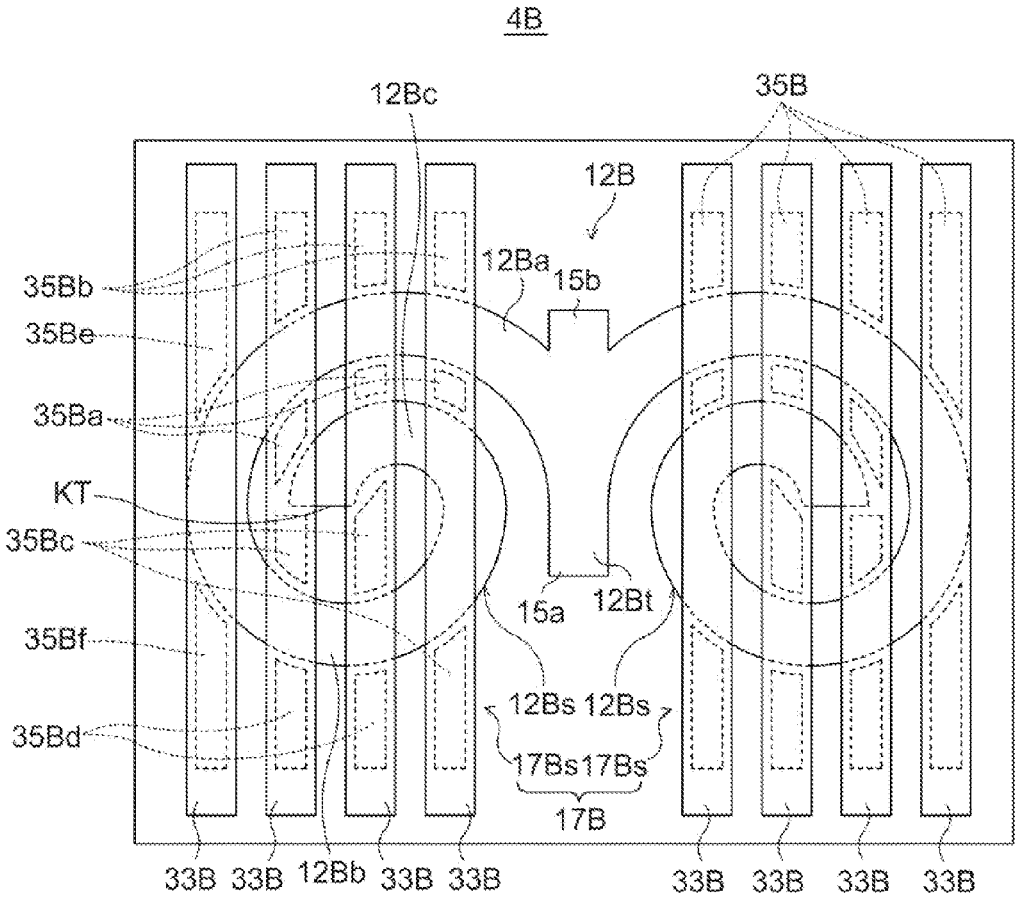
FIG. 3 is a plan view illustrating an example of a variable distributed constant line according to a second embodiment.

Referring to FIG. 3, the variable distributed constant line 4B of the second embodiment is provided with a substrate 11, a line 12B, and a variable capacitor 17B.

The line 12B is provided, on the substrate 11, with a linear portion 12Bt, and two line portions 12Bs symmetrically arranged on both sides of the linear portion 12Bt respectively.

The linear portion 12Bt has an input terminal 15*a* at one end thereof and an output terminal 15*b* at the other end thereof.

Each of the line portions 12Bs is provided in a spirally rolled shape and includes first line portion 12Ba, second line portion 12Bb, and third line portion 12Bc which individually face each another. As illustrated in FIG. 3, these first to third line portions 12Ba-12Bc extend in parallel with each another. Although the leading edge of the third line portion 12Bc is arranged as an open end KT, it may be connected to the ground.

As the variable capacitor 17B, variable capacitor portions 17Bs are provided right and left in a manner to correspond to the right and left line portions 12Bs of the line 12B. The variable capacitor portions 17Bs individually include a plurality of movable electrodes 33B and a plurality of driving electrodes 35B.

Each of the movable electrodes 33B is provided above the substrate 11, and straddles over and faces any of the first to third line portions 12Ba-12Bc. Each of the driving electrodes 35B is provided on the substrate 11 so as to face the movable electrode 33B, attracts the movable electrode 33B by an action of an electrostatic attractive force generated by a voltage applied between the movable electrode 33B and the driving electrode 35B, and changes the distance between the line 12B and the movable electrode 33B.

Provided as the driving electrode 35B are a plurality of electrodes 35Ba-35Bf arranged on both sides of the first to third line portions 12Ba-12Bc individually in a manner to interpose the first to third line portions 12Ba-12Bc therebetween individually.

Specifically, for example, the electrode 35Ba is disposed between the first line portion 12Ba and the third line portion 12Bc. The electrode 35Bb is disposed in a manner to interpose the first line portion 12Ba between the electrode 35Ba and the electrode 35Bb. The electrode 35Bc is disposed in a manner to interpose the third line portion 12Bc between the electrode 35Ba and the electrode 35Bc. The electrode 35Bd is disposed in a manner to interpose the second line portion 12Bb between the electrode 35Bc and the electrode 35Bd. The electrodes 35Be and 35Bf are disposed in a manner to interpose therebetween the first line portion 12Ba and the second line portion 12Bb.

In any of the cases, the movable electrode 33B faces the plurality of electrodes 35Ba-35Bf. This makes it possible to enlarge the area of the driving electrode 35B in a parallel plate type actuator.

Accordingly, in the variable distributed constant line 4B, the driving force for the movable electrode 33B increases; the strength of the spring of the movable electrode 33B can be increased; and the occurrence of the self-actuation phenomenon can be suppressed. As a result, stability in driving the movable electrode 33B can be further improved, and the reliability can be further improved.

Third Embodiment

Next, a description will be given of a variable filter 3C as the third embodiment.

Figure 4:
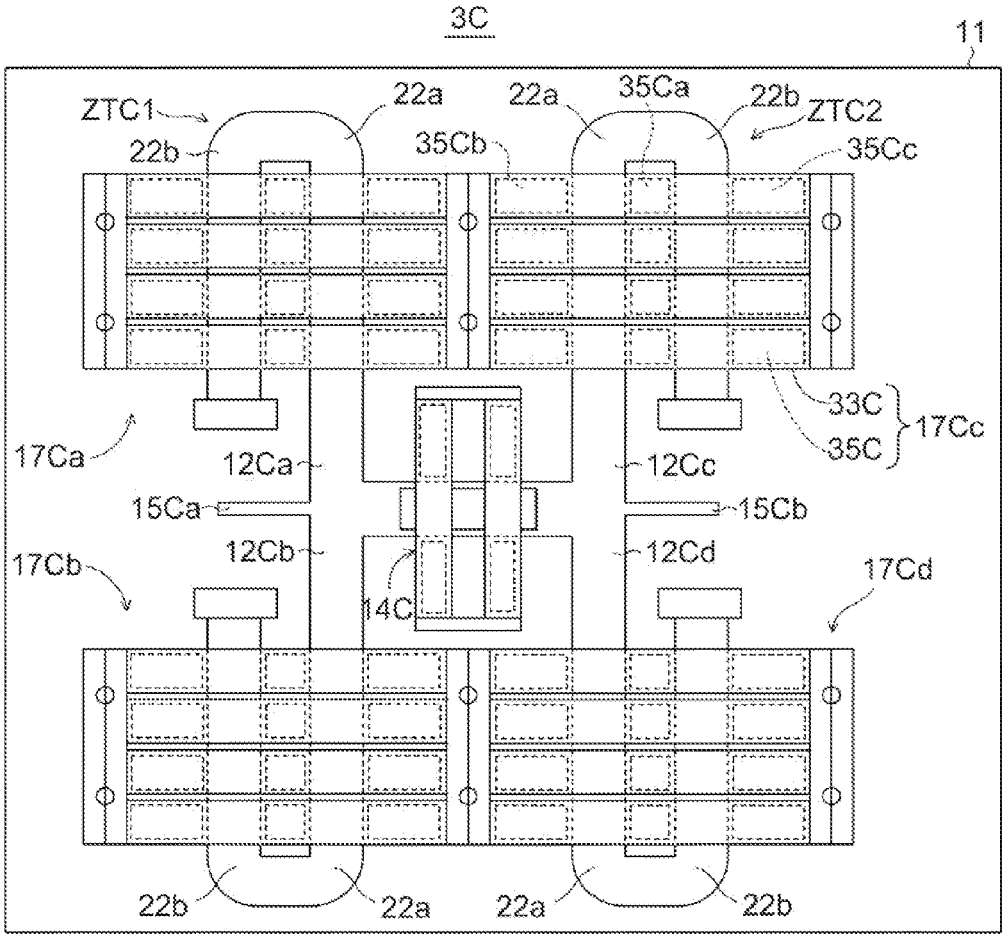
FIG. 4 is a plan view illustrating an example of a variable filter according to a third embodiment.
Figure 5:
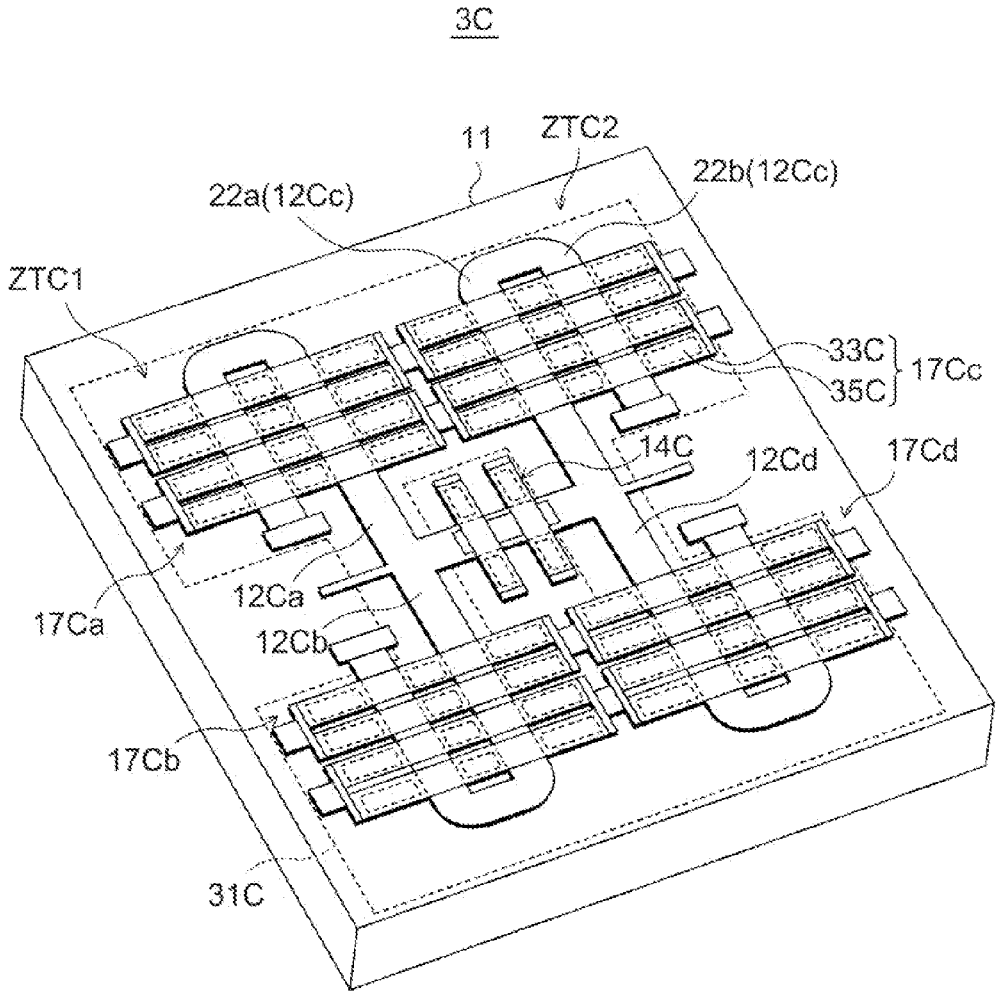
FIG. 5 is a perspective view of the variable filter of FIG. 4.

Referring to FIGS. 4 and 5, the variable filter 3C is provided with a substrate 11, resonant lines 12Ca-12Cd, a coupling portion 14C, an input terminal 15Ca, an output terminal 15Cb, and a variable capacitor 17C.

The resonant lines 12Ca and 12Cc serve as a first resonant line, and the resonant lines 12Cb and 12Cd serve as a second resonant line. The first resonant line 12Ca and the second resonant line 12Cb form a pair of resonant lines ZTC1, and the first resonant line 12Cc and the second resonant line 12Cd form another pair of resonant lines ZTC2.

The resonant lines 12Ca-12Cd have individual propagation lengths of $L_1$, $L_2$, $L_3$, and $L_4$. The two pairs of resonant lines ZTC1 and ZTC2 have the same pass-through loss properties by arranging the propagation lengths $L_1$ and $L_2$ of the resonant lines 12Ca and 12Cc to be identical with each other and arranging the propagation lengths $L_2$ and $L_4$ of the resonant lines 12Cb and 12Cd to be identical with each other. By arranging them different from each other so that the two pairs of resonant lines ZTC1 and ZTC2 have pass-through loss properties different from each other, it is possible to make a band-pass filter having desired pass-through loss properties.

Each of the resonant lines 12Ca-12Cd includes a first line portion 22*a* stretching linearly, and a second line portion 22*b* that is folded at a leading portion of the first line portion 22*a* and extends in parallel with and with a distance away from the first line portion 22*a*. Although the leading end of the second line portion 22*b* is connected to the ground, it may be arranged as an open end which is electrically opened.

The coupling portion 14C serves a role of rotating the phase of a high-frequency signal resonating in the pair of resonant lines ZTC1 by 90 degrees ($\lambda/4$), and transmitting the resultant signal without reflection to the next pair of resonant lines ZTC2. This means that the coupling portion 14C serves a role of applying selectivity to a specific frequency component in an inputted high-frequency signal for outputting the signal, performing impedance matching, and transmitting the signal to the next input point.

The coupling portion 14C serves as a role of a distributed constant line having a propagation length $L_{14}$ which corresponds to $\lambda_{14}/4$. The wavelength $\lambda_{14}$ may be arranged to be identical with a propagation length $L_0$, i.e., a sum of those of the resonant lines 12Ca and 12Cb; a propagation length $L_0$, i.e., a sum of those of the resonant lines 12Cc and 12Cd; or a propagation length $L_0$, i.e., a value intermediate between the former two. In other words, the coupling portion 14C may be arranged as a distributed constant line having a propagation length $L_{14}$ of $\lambda_0/4$ for a passband center wavelength $\lambda_0$ in the variable filter 3C. With this arrangement, the high-frequency signal at a passband center wavelength $\lambda_0$ can be transmitted without loss and the steepness of the pass-through loss properties can be increased.

The coupling portion 14C is provided with the variable capacitor as described above whose propagation length or pass-through frequency is varied and adjusted by the variable capacitor. Alternatively, the coupling portion 14C may be provided with a variable capacitor element different from the one described above, or may be provided with a variable inductance element instead of or together with the variable capacitor or the variable capacitor element.

It is also possible to use a $\pi$-type coupling, a T-type coupling, or another coupling portion as the coupling portion 14C.

It is also possible to use a variable distributed constant line or a lumped constant element circuit as the coupling portion 14C.

The variable capacitors 17Ca-17Cd are provided for the resonant lines 12Ca-12Cd, respectively. These variable capacitors 17Ca-17Cd have either a shape identical with one another or shapes that are symmetrical, and functions identical with one another. Therefore, a description will be given of the single variable capacitor 17Cc.

The variable capacitor 17Cc is provided for the resonant line 12Cc.

A part or the whole of the variable capacitors 17Ca-17Cd and the resonant lines 12Ca-12Cd may be sometimes described as "variable capacitor 17C" and "resonant line 12C", respectively.

The variable capacitor 17C includes a plurality of movable electrodes 33C and a plurality of driving electrodes 35C.

Each of the movable electrodes 33C is provided above the substrate 11 and straddles over and faces both of the first line portion 22*a* and the second line portion 22*b*. Each of the driving electrodes 35C is provided on the substrate 11 so as to face each of the movable electrodes 33C, attracts the movable electrode 33C by an action of a voltage applied between the movable electrode 33C and the driving electrode 35C, and changes the distance between the resonant line 12C and the movable electrode 33C.

Provided as the driving electrode 35C are a first electrode 35Ca, a second electrode 35Cb, and a third electrode 35Cc.

The first electrode 35Ca is disposed between the first line portion 22*a* and the second line portion 22*b*. The second electrode 35Cb is disposed in a manner to interpose the first line portion 22*a* between the first electrode 35Ca and the second electrode 35Cb. The third electrode 35Cc is disposed in a manner to interpose the second line portion 22*b* between the first electrode 35Ca and the third electrode 35Cc.

As indicated by a broken line in FIG. 5, a ground layer 31C is provided in the substrate 11. The ground layer 31C is commonly provided to encompass and face the whole of the resonant lines 12C and the variable capacitors 17.

These resonant line 12C, the coupling portion 14C, the input terminal 15Ca, the output terminal 15Cb, the variable capacitor 17C, the ground layer 31C, and so on are electrically connected to the pad portions etc. provided on a lower face of the substrate 11 or the like through the internal wiring and the vias of the substrate 11.

By adjusting the voltage Vb applied to each of the driving electrodes 35C, the variable filter 3C can variably drive the variable capacitors 17Ca-17Cd to thereby adjust and set the passband center wavelength $\lambda_0$, the attenuation peak wavelengths $\lambda_L$ and $\lambda_H$, and the pass-band width $\lambda_T$ to various values.

In the variable filter 3C, since each of the movable electrodes 33C faces the plurality of electrodes 35Ca-35Cc, it is possible to enlarge the area of the driving electrode 35C in a parallel plate type actuator.

As a result, the driving force for the movable electrode 33C increases, and the strength of the spring of the movable electrode 33C can also be increased. This makes it possible to suppress an occurrence of a self-actuation phenomenon. With this arrangement, the stability in driving the movable electrode 33C can be further improved, and the reliability of the movable filter 3C can be further improved.

Further, since a Low Temperature Co-fired Ceramics substrate having multilayered internal wiring is used as the substrate 11 in the variable filter 3C, the internal wiring of the substrate 11 can be utilized as the ground layer 31C. This allows the line 12 to be arranged easily as a microstrip type transmission line.

In this connection, if the Low Temperature Co-fired Ceramics substrate having multilayered internal wiring is not used as the substrate 11, a ground layer for forming a microstrip type transmission line is separately provided. In such a case, wiring leading to the driving electrode 35 or the like may pass through between the ground layer and the line 12C, which may make it difficult to perform impedance matching.

In the variable filter 3C according to this embodiment, taken as an example is a configuration in which each of the variable capacitors 17Ca-17Cd includes four movable electrodes 33C with respect to each of the resonant lines 12Ca-12Cd. However, the quantity of the movable electrodes 33C may be one to three, or five or more. The individual areas of the movable electrodes 33C or individual gaps between the movable electrodes 33C and the resonant lines may be arranged differently from one another.

[Communication Module]

The variable filter 3C and the variable distributed constant lines 4 and 4B described above can be arranged as a communication module TM.

Figure 8:
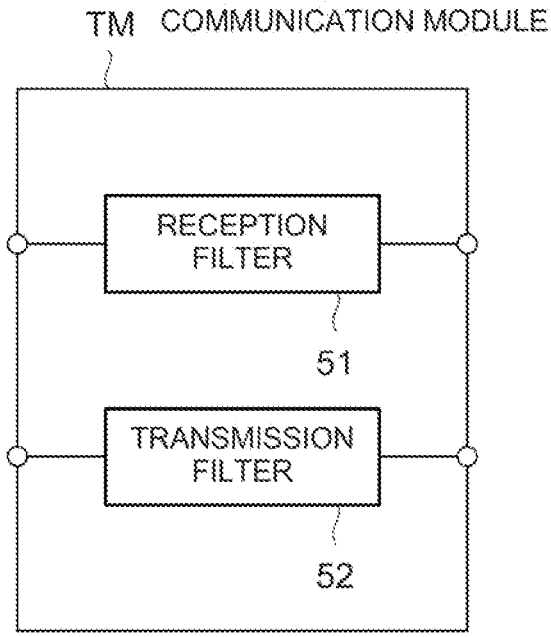
FIG. 8 is a diagram illustrating an example of a configuration of a communication module.

Referring to FIG. 8, the communication module TM includes a transmission filter 51 and a reception filter 52. The variable filter 3C described above can be applied as the transmission filter 51 and the reception filter 52.

When the variable filters 3C are used, a control voltage Vb is applied to each of the variable filters 3C, and a pass-through center frequency $f_0$, attenuation frequencies $f_L$ and $f_H$, and pass-through loss properties are determined to be adaptable to the communication requirements for such an occasion. Therefore, in such a case, the number of filters in the transmission filters 52 or the reception filters 53 can be reduced, leading to miniaturization of the communication module TM. Additionally, reducing the number of filters contributes to simplification of the circuit and decreasing the circuit loss, the circuit noises, or the like. Consequently, this makes it possible to improve the performance of the communication module TM.

The communication module TM may be configured in various ways other than the configuration illustrated in FIG. 8.

[Communication Device]

The variable filter 3C according to this embodiment may be applied to a variety of communication devices such as a cellular phone, a mobile communication device such as a mobile terminal, a base-station apparatus, and a fixed communication device.

Hereinafter, a description will be given of an example of a communication device to which the variable filter 3C is applied.

Figure 9:
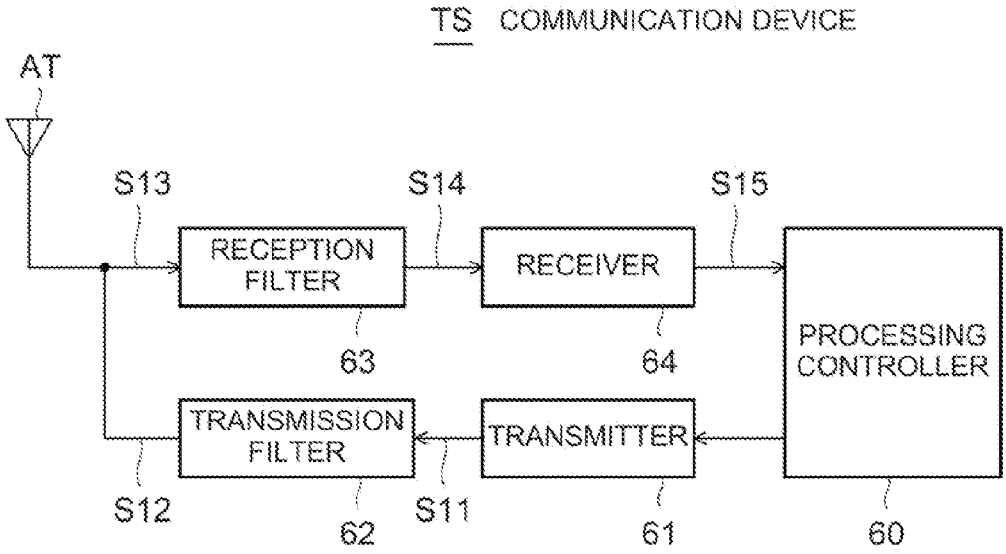
FIG. 9 is a diagram illustrating an example of a configuration of a communication device.

Referring to FIG. 9, the communication device TS includes a processing controller 60, a transmitter 61, a transmission filter 62, a reception filter 63, a receiver 64, an antenna AT, and so on.

The processing controller 60 performs overall control of the communication device TS such as digital and analogue processing required by the communication device TS, and human interface processing between the device and the user.

The transmitter 61 performs modulation etc., and outputs a high-frequency signal S11. The high-frequency signal S11 includes signals of different frequency bands.

The transmission filter 62 performs a filtering process on the high-frequency signal S11 outputted from the transmitter 61 so that only a frequency band specified by the processing controller 60 can pass through. A high-frequency signal S12 that has been subjected to the filtering is outputted from the transmission filter 62. The variable filter 3C described above or a modified type thereof can be used as the transmission filter 62.

The reception filter 63 performs a filtering process on a high-frequency signal S13 received by the antenna AT so that only a frequency band specified by the processing controller 60 can pass through. A high-frequency signal S14 that has been subjected to the filtering is outputted from the reception filter 63. The variable filter 3C described above or a modified type thereof can be used as the reception filter 63.

The receiver 64 performs amplification and demodulation on the high-frequency signal S14 outputted from the reception filter 63, and outputs a reception signal S15 thus obtained to the processing controller 60.

The antenna AT radiates out, into the air, the high-frequency signal S12 outputted from the transmission filter 62 as radio waves, and receives radio waves transmitted from unillustrated radio stations.

When the variable filter 3C is used as the transmission filter 62 or the reception filter 63, a control voltage Vb is applied under command from the processing controller 60, and a pass-through center frequency $f_0$, attenuation frequencies $f_L$ and $f_H$, and pass-through loss properties are determined to be adaptable to the communication requirements for such an occasion. Therefore, in such a case, the number of the filters in the transmission filter 62 or the reception filter 63 can be reduced, leading to miniaturization of the communication device TS. Additionally, reducing the number of filters contributes to simplification of the circuit and decreasing the circuit loss, the circuit noises, or the like. Consequently, this makes it possible to improve the performance of the communication device TS.

In the configuration of the communication device TS discussed above, the filter may be provided as a circuit element other than the transmission filter 62 and the reception filter 63, for example, as a band-pass filter for an intermediate frequency. Further, a switch is provided as required for switching among the antenna AT, the transmission filter 62, and the reception filter 63 in transmission and reception. It is also possible to use the communication module TM described above as the transmission filter 62 and the reception filter 63.

Further, the communication device TS is provided, as necessary, with a low-noise amplifier, a power amplifier, a duplexer, an A/D converter, a D/A converter, a frequency synthesizer, an ASIC (Application Specific Integrated Circuit), a DSP (Digital Signal Processor), a power supply device, and so on.

If the communication device TS is a cellular phone, the communication device TS is configured in accordance with the communication system, and also a frequency band according to the communication system is selected for the transmission filter 62 or the reception filter 63. For example, in the case of the GSM (Global System for Mobile Communications) system, the communication device TS, the transmission filter 62, and the reception filter 63 are set to correspond to the frequency bands of 850 MHz, 950 MHz, 1.8 GHz, and 1.9 GHz. It is also possible to configure the communication device TS by adapting the variable filter 3C etc. according to this embodiment to the frequency band higher than 2 GHz, for example, 6 GHz or 10 GHz.

In the embodiments discussed above, the overall configurations of the substrate 11, the lines 12, 12B, and 12C, the first line portion 12*a*, the second line portion 12*b*, the variable capacitors 17, 17B, and 17C, the movable electrodes 33, 33B, and 33C, the driving electrodes 35, 35B, and 35C, the variable distributed constant lines 4 and 4B, the variable filter 3C, the communication module TM, and the communication device TS, the configurations of various parts thereof, the structure, the shape, the dimensions, the material, the forming method, the production method, the layout, the quantity, the location thereof, and the like may be altered as required in accordance with the subject matter of the present invention.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A communication module comprising a variable filter, the variable filter comprising:

a substrate;

a resonant line that is provided on the substrate, and includes a first line portion and a second line portion extending in a manner to face each other from an input point to which a high-frequency signal is inputted;

a movable electrode that is provided above the substrate, and straddles the first line portion and the second line portion in a manner to face the first line portion and the second line portion; and a driving electrode that is provided on the substrate, attracts the movable electrode by an action of a voltage applied between the driving electrode and the movable electrode, and changes a distance between the resonant line and the movable electrode, wherein the driving electrode comprises:

a first electrode arranged between the first line portion and the second line portion;

a second electrode arranged to interpose the first line portion between the first electrode and the second electrode; and a third electrode arranged to interpose the second line portion between the first electrode and the third electrode.

2. A variable distributed constant line, comprising:

a substrate;

a signal line that is provided on the substrate, and includes a first line portion and a second line portion facing each other;

a movable electrode that is provided above the substrate, and straddles both the first line portion and the second line portion in a manner to face the first line portion and the second line portion; and a driving electrode that is provided on the substrate in a manner to face the movable electrode, attracts the movable electrode by an action of a voltage applied between the driving electrode and the movable electrode, and changes a distance between the signal line and the movable electrode, wherein the driving electrode comprises:

a first electrode arranged between the first line portion and the second line portion;

a second electrode arranged to interpose the first line portion between the first electrode and the second electrode; and a third electrode arranged to interpose the second line portion between the first electrode and the third electrode.

3. The variable distributed constant line according to claim 2, wherein the voltage comprises voltages that are identical with each other being applied to the second electrode and the third electrode, and the voltage further comprises a voltage different from the voltages applied to the second electrode and the third electrode being applied to the first electrode.

4. A variable filter, comprising:

a substrate;

a resonant line that is provided on the substrate, and includes a first line portion and a second line portion extending in a manner to face each other from an input point to which a high-frequency signal is inputted;

a movable electrode that is provided above the substrate, and straddles the first line portion and the second line portion in a manner to face the first line portion and the second line portion; and a driving electrode that is provided on the substrate, attracts the movable electrode by an action of a voltage applied between the driving electrode and the movable electrode, and changes a distance between the resonant line and the movable electrode, wherein the driving electrode comprises:

a first electrode arranged between the first line portion and the second line portion;

a second electrode arranged to interpose the first line portion between the first electrode and the second electrode; and a third electrode arranged to interpose the second line portion between the first electrode and the third electrode.

5. The variable filter according to claim 4, further comprising a plurality of pairs of resonant lines each of which includes a corresponding additional first resonant line and a corresponding additional second resonant line, wherein the plurality of pairs of resonant lines are sequentially connected to one another by a coupling portion.

6. The variable filter according to 4, wherein the substrate is a low temperature co-fired ceramics substrate including multilayered internal wiring.

* * * * *